US010003142B1

(12) United States Patent
Lin

(10) Patent No.: US 10,003,142 B1
(45) Date of Patent: Jun. 19, 2018

(54) TERMINAL BLOCK

(71) Applicant: Excel Cell Electronic Co., Ltd., Taichung (TW)

(72) Inventor: Chih-Ming Lin, Taichung (TW)

(73) Assignee: EXCEL CELL ELECTRONIC CO., LTD., Taichung (TW)

( * ) Notice: Subject to any disclaimer, the term of this patent is extended or adjusted under 35 U.S.C. 154(b) by 0 days. days.

(21) Appl. No.: 15/606,419

(22) Filed: May 26, 2017

(30) Foreign Application Priority Data

Dec. 13, 2016 (TW) ..... 105141179 A

(51) Int. Cl.
*H01R 9/22* (2006.01)
*H01R 9/24* (2006.01)
*H01R 4/48* (2006.01)

(52) U.S. Cl.
CPC ..... *H01R 9/2416* (2013.01); *H01R 4/4809* (2013.01)

(58) Field of Classification Search
CPC .. H01R 4/4827; H01R 4/4809; H01R 4/4836; H01R 9/2416
USPC ..... 439/722
See application file for complete search history.

(56) References Cited

U.S. PATENT DOCUMENTS 6,261,120 B1 * 7/2001 Beege ..... H01R 4/4836 439/268
7,329,143 B2 * 2/2008 Schrader ..... H01R 4/4827 439/441
9,083,115 B2 * 7/2015 Hoppmann ..... H01R 4/4827
9,276,334 B1 * 3/2016 Daily ..... H01R 4/4827
9,502,795 B1 * 11/2016 Wu ..... H01R 4/4827
9,680,237 B2 * 6/2017 Aporius ..... H01R 4/4836

FOREIGN PATENT DOCUMENTS

TW 201136076 A1 10/2011

OTHER PUBLICATIONS

Search Report appended to an Office Action issued to Taiwanese counterpart application No. 105141179 by the TIPO dated Aug. 10, 2017, with an English translation thereof.

* cited by examiner

*Primary Examiner* — Jean F Duverne
(74) *Attorney, Agent, or Firm* — Trop Pruner & Hu, P.C.

(57) ABSTRACT

A terminal block is adapted to be connected to a wire, and includes an insulating base seat and a clamping unit. The insulating base seat includes first and second seat portions cooperating with each other to define a passage and a receiving space that communicates with the passage. The clamping unit includes a positioning member connected to the first seat portion and having an upper press section, and a resilient member having a base portion that is proximate to the second seat portion, and a resilient arm portion that is connected to the base portion, and that has a lower press section extending toward the positioning member. The upper and lower press sections are adapted for clamping resiliently an end segment of the wire therebetween.

10 Claims, 13 Drawing Sheets

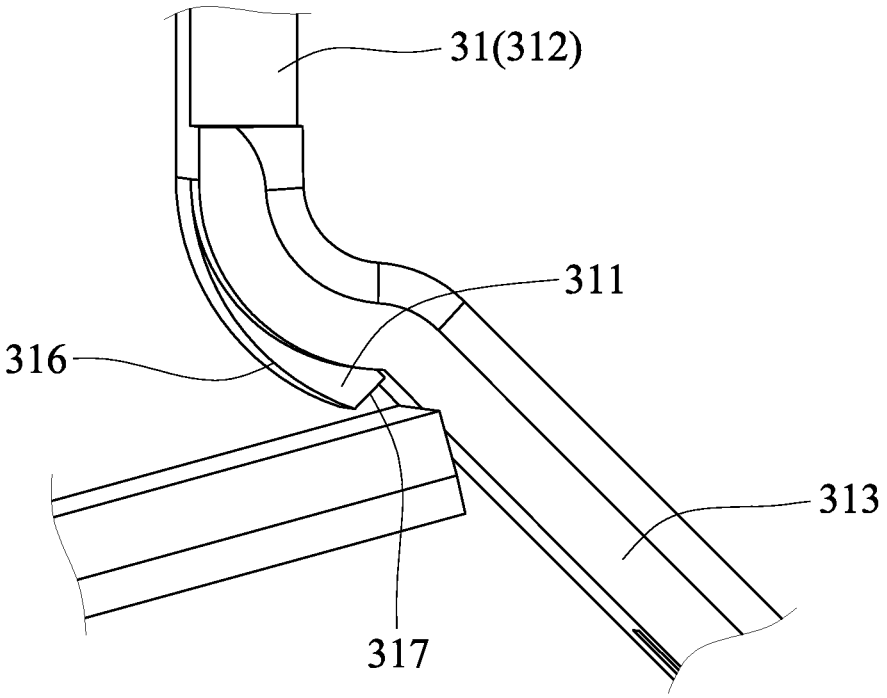
FIG.8
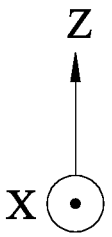

TERMINAL BLOCK

CROSS-REFERENCE TO RELATED APPLICATION

This application claims priority of Taiwanese Patent Application No. 105141179, filed on Dec. 13, 2016.

FIELD

The disclosure relates to a terminal block, and more particularly to a terminal block adapted for electrical connection with a wire.

BACKGROUND

Referring to FIGS. 1 and 2, a conventional terminal block 1 is adapted to be connected to a wire 9. The conventional terminal block 1 includes an insulating base seat 11, a terminal member 12, a pressing member 13, and a releasing member 14. The insulating base seat 11 has a first seat portion 111 and a second seat portion 112 connected to the first seat portion 111 and cooperating with the first seat portion 111 to define a passage 113 that is adapted for insertion of the wire 9 therethrough, and a receiving space 114 that is in communication with the passage 113 and that is adapted to receive an end segment of the wire 9. The terminal member 12 is received in the receiving space 114 and has an end portion 121, and two contact portions 122 bent from the end portion 121 and extending outwardly of the insulating base seat 11. The pressing member 13 has a base portion 131 connected to the second seat portion 112, and a resilient arm portion 132 extending from the fixing portion 131 toward the first seat portion 111. The releasing member 14 is movably disposed in the second seat portion 112, and is operable to bias the arm portion 132 of the pressing member 13 away from the first seat portion ill.

During use, the wire 9 is inserted into the receiving space 114 through the passage 113, and the end segment of the wire 9 pushes the arm portion 132 to deform, thereby permitting the wire 9 to advance further to pass through a gap between the arm portion 132 and the end portion 121 of the terminal member 12. At the same time, a restoring force of the arm portion 132 urges the arm portion 132 to press the end segment of the wire 9 against the end portion 121 of the terminal member 12 so as to position the wire 9 between the arm portion 132 and the end portion 121 of the terminal member 12.

However, since the end portion 121 of the terminal member 12 is flat, the wire 9 may not be effectively secured between the arm portion 132 of the pressing member 13 and the end portion 121 of the terminal member 12, and may be pulled away from the arm portion 132, thus causing electrical disconnection.

Furthermore, since the conventional terminal block 1 includes a substantial number of the abovementioned components, which are individually manufactured, assembling of such components is relatively time consuming and costly.

SUMMARY

Therefore, an object of the disclosure is to provide a terminal block that can alleviate at least one of the drawbacks associated with the abovementioned prior art.

Accordingly, the terminal block is adapted to be connected to a wire. The terminal block includes an insulating base seat and a clamping unit. The insulating base seat includes first and second seat portions. The second seat portion is connected to the first seat portion, and cooperates with the first seat portion to define a passage adapted for insertion of the wire therethrough, and a receiving space communicating with the passage and adapted for receiving an end segment of the wire. The clamping unit includes a positioning member and a resilient member. The positioning member is connected to the first seat portion and has an upper press section. The resilient member has a base portion proximate to the second seat portion, and a resilient arm portion connected to the base portion and having a lower press section that is distal from the base portion and that extends toward the positioning member. The upper press section of the positioning member and the lower press section of the arm portion of the resilient member are adapted for cooperatively and resiliently clamping the end segment of the wire therebetween.

BRIEF DESCRIPTION OF THE DRAWINGS

Other features and advantages of the disclosure will become apparent in the following detailed description of the embodiment with reference to the accompanying drawings, of which:

FIG. 8 is a fragmentary enlarged view of FIG. 7;

DETAILED DESCRIPTION

Figure 1:
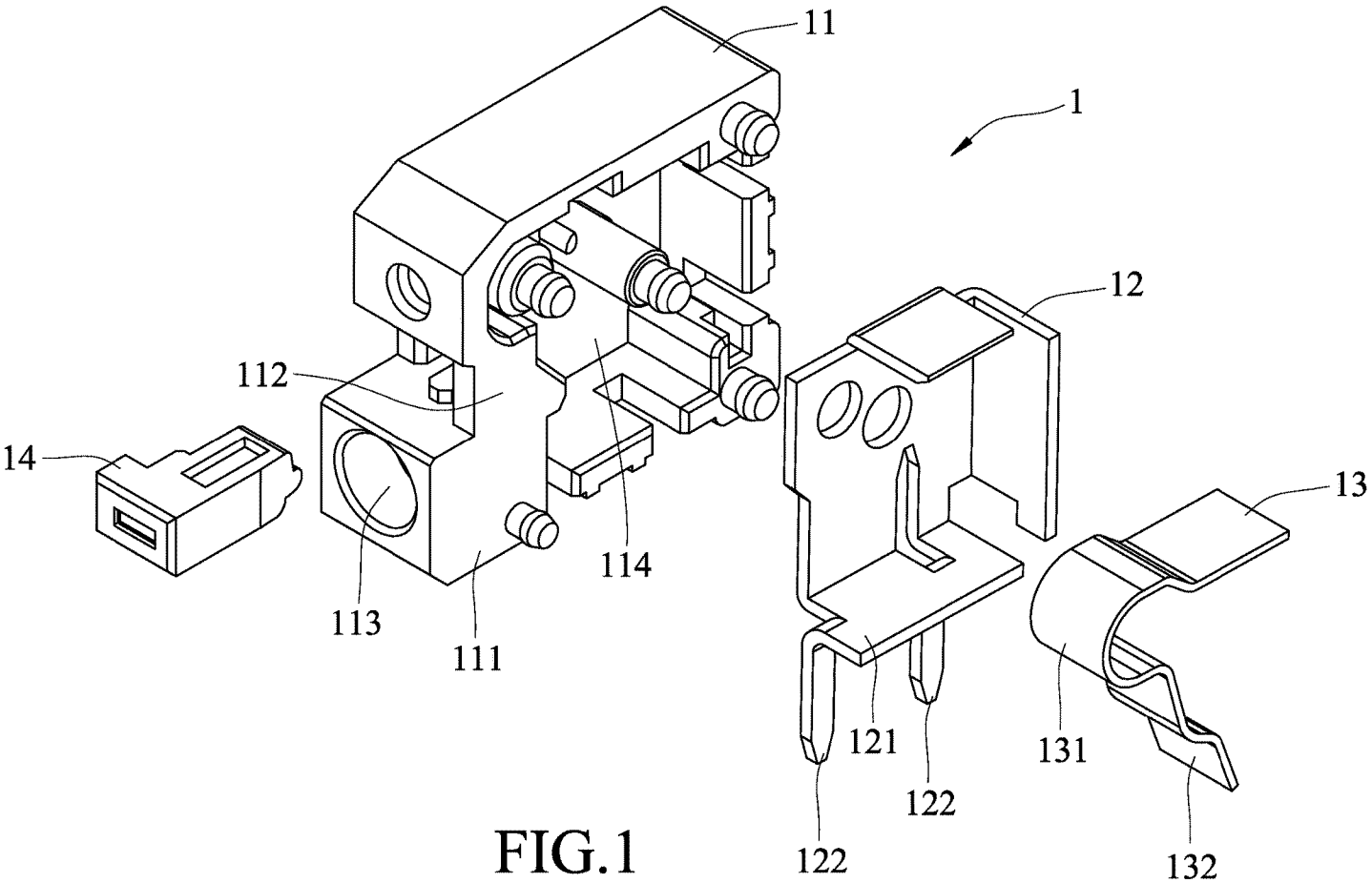
FIG.1 PRIOR ART
FIG. 1 is an exploded perspective view of a conventional terminal block.
Figure 2:
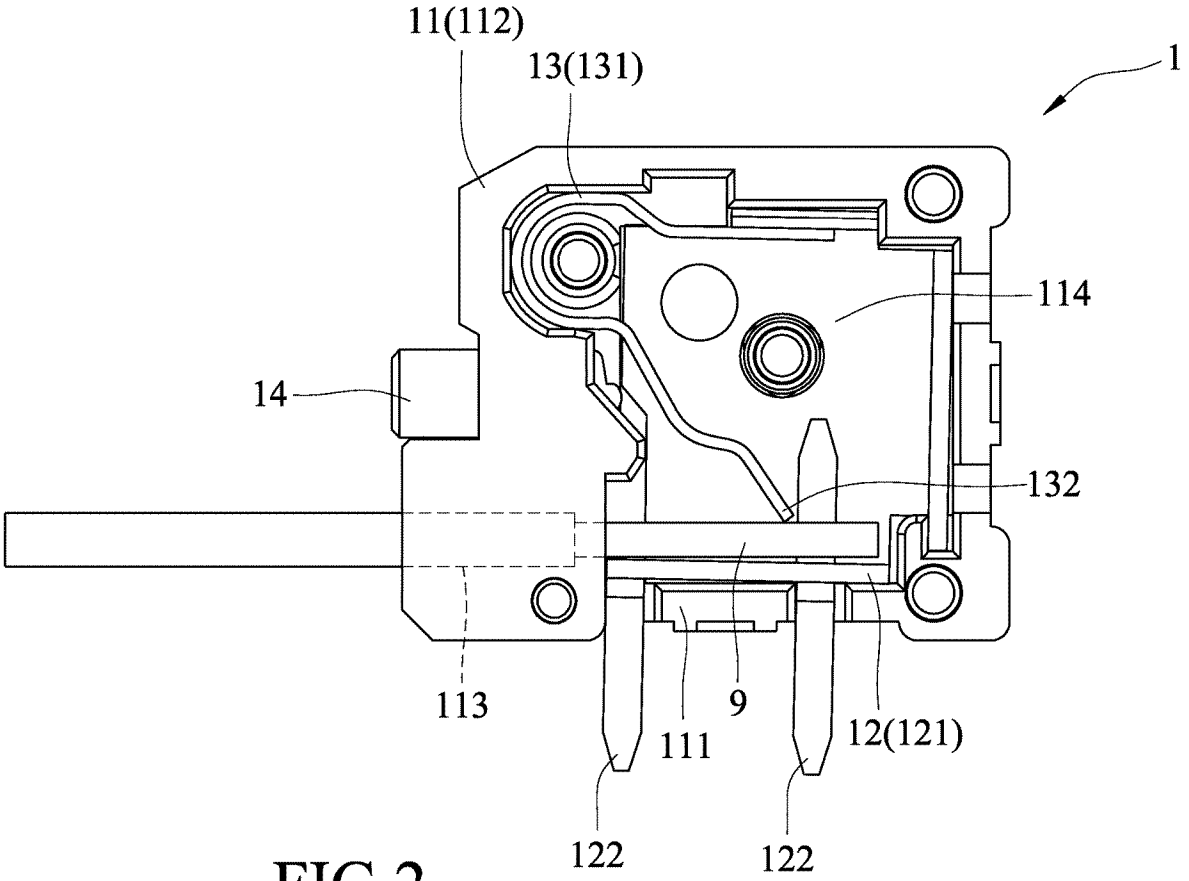
FIG.2 PRIOR ART
FIG. 2 is a side view of the conventional terminal block being connected to a wire.

Before the present invention is described in greater detail, it should be noted that where considered appropriate, reference numerals or terminal portions of reference numerals have been repeated among the figures to indicate corresponding or analogous elements, which may optionally have similar characteristics.

Figure 3:
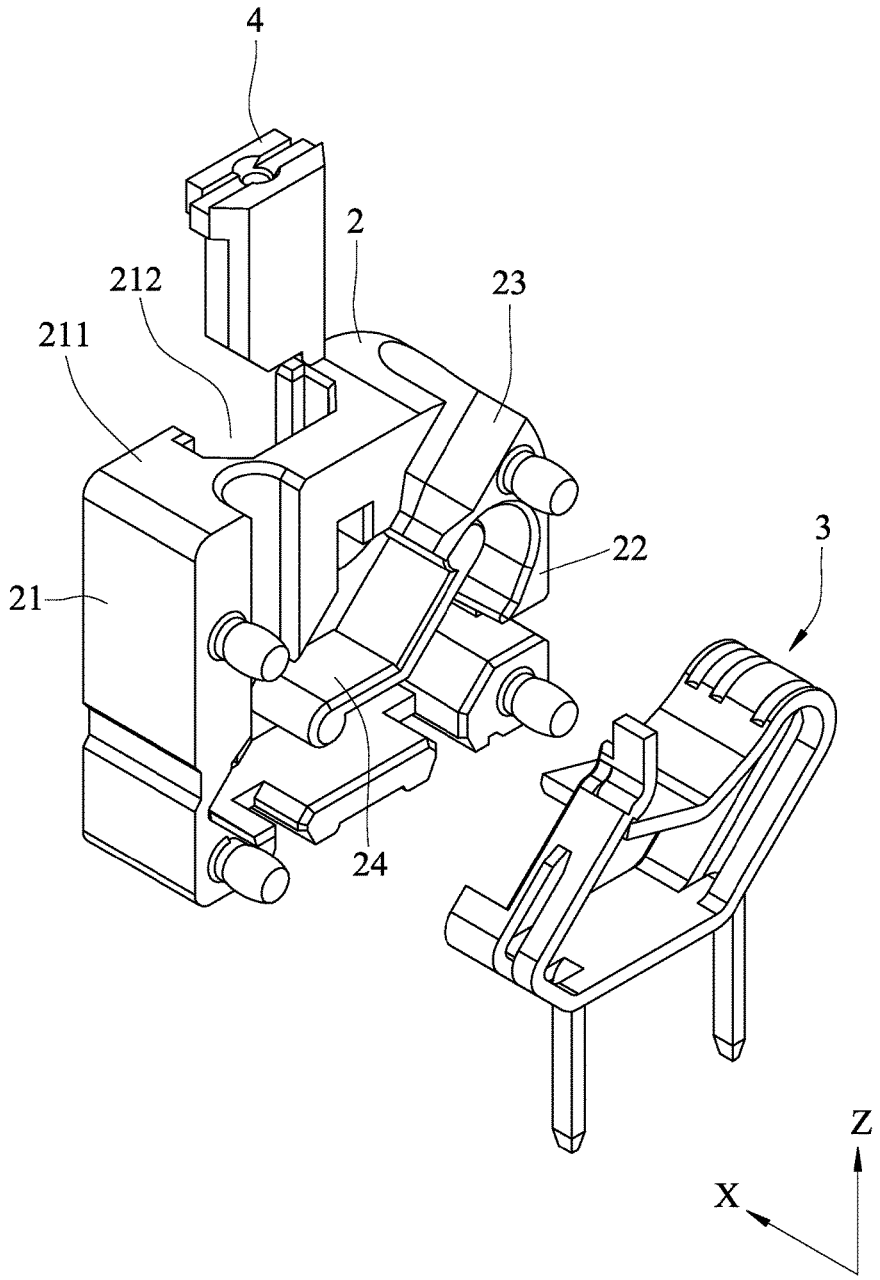
FIG. 3 is an exploded perspective view of a first embodiment of a terminal block according to the present disclosure.
Figure 4:
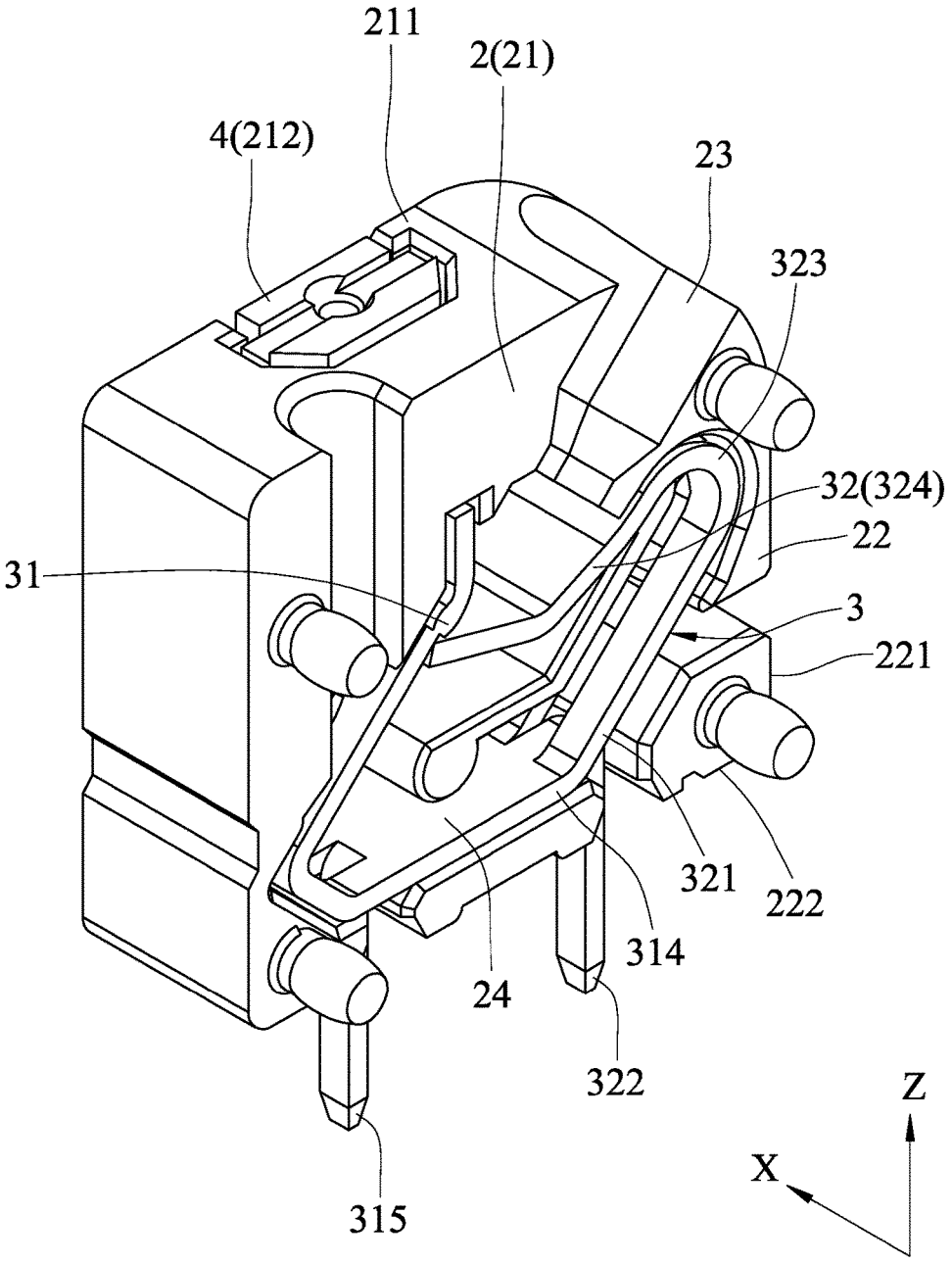
FIG. 4 is an assembled perspective view of the first embodiment.
Figure 5:
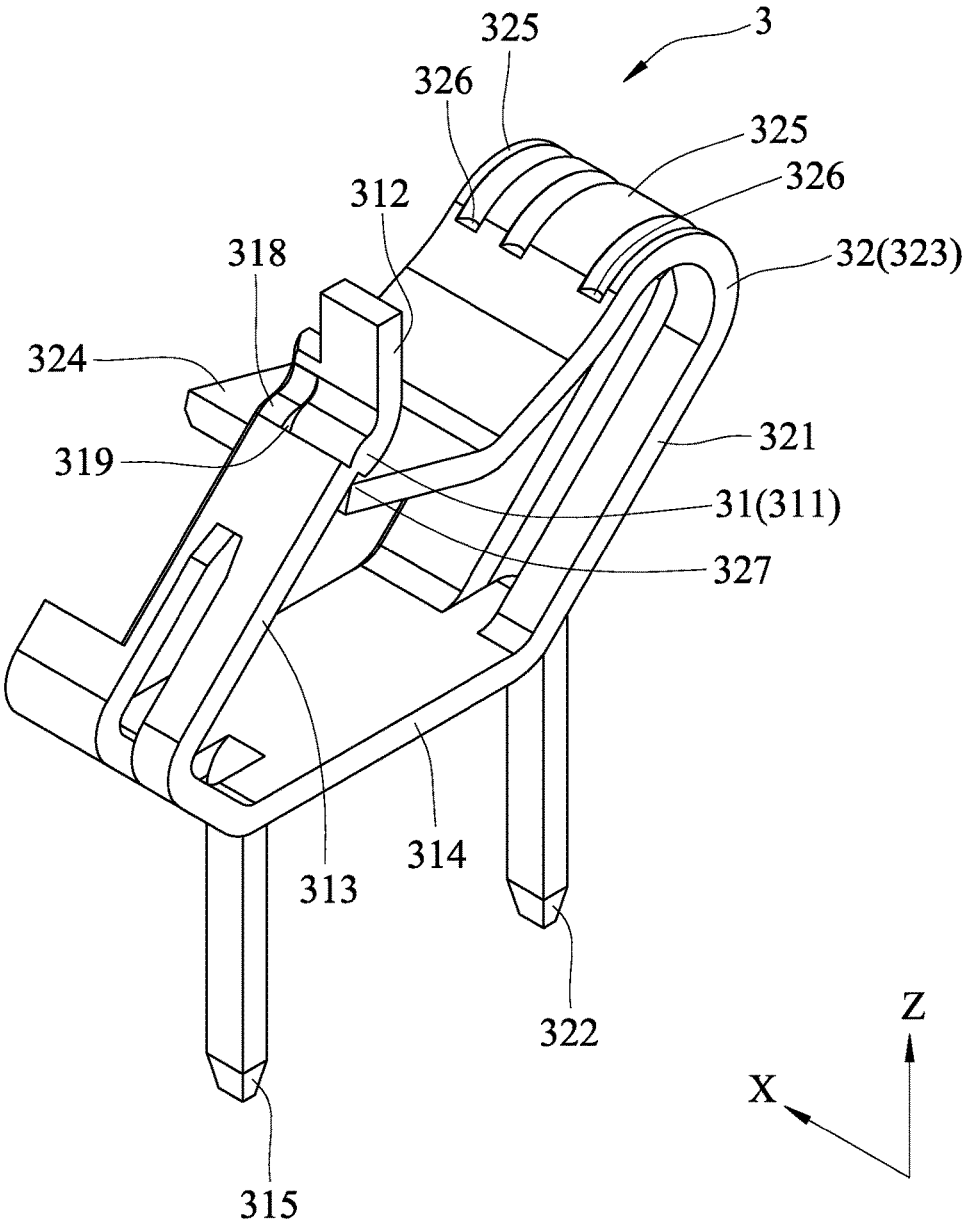
FIG. 5 is a perspective view of a clamping unit of the first embodiment.
Figure 10:
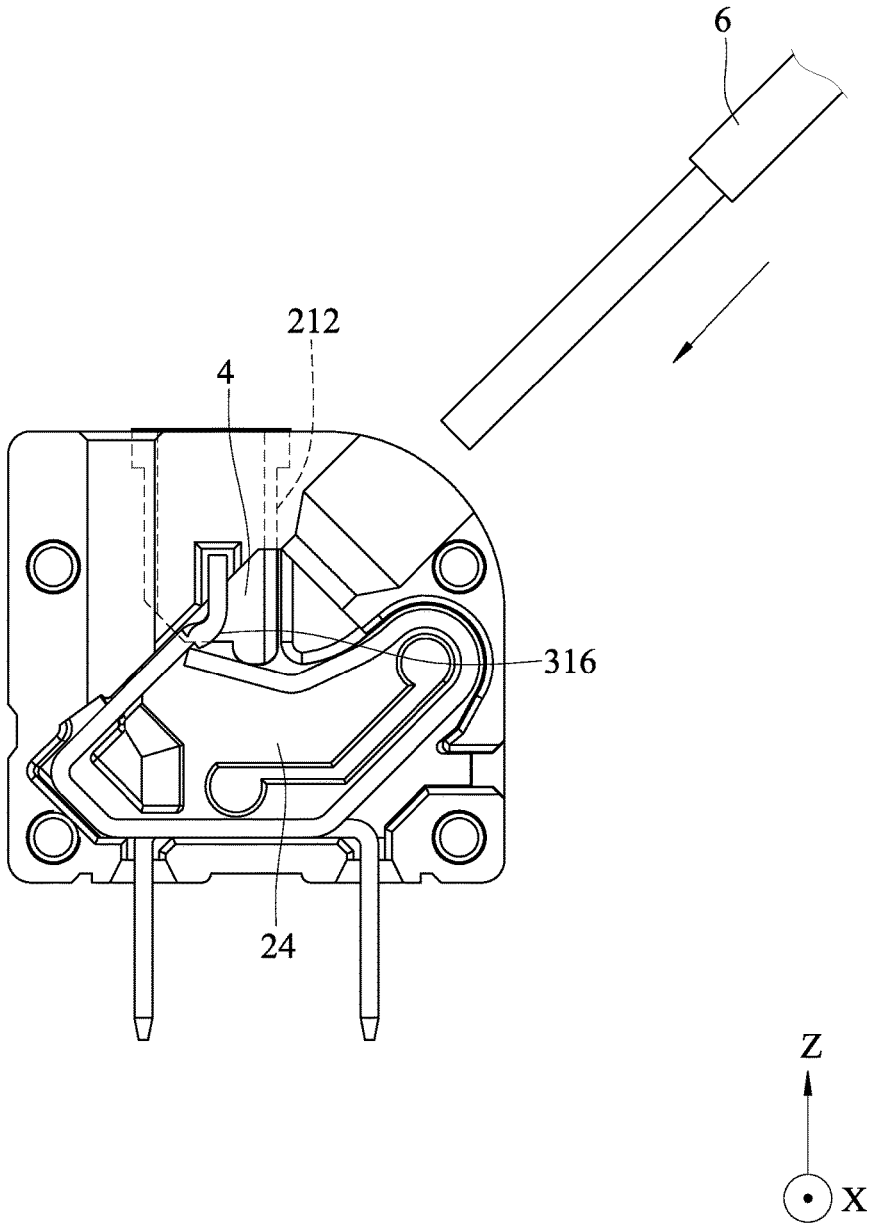
FIG. 10 is a side view illustrating the first embodiment before an insertion of a wire thereinto.

Referring to FIGS. 3 to 5, a first embodiment of a terminal block according to the disclosure is adapted to be connected to a wire 6 (see FIG. 10). The terminal block includes an insulating base seat 2, a clamping unit 3, and a releasing member 4.

The insulating base seat 2 includes a first seat portion 21 and a second seat portion 22. The second seat portion 22 is connected to the first seat portion 21, and cooperates with the first seat portion 21 to define a passage 23 adapted for insertion of the wire 6 therethrough, and a receiving space 24 communicating with the passage 23 and adapted for receiving an end segment of the wire 6.

The first seat portion 21 has a first end surface 211 proximate to said passage 23, a rail groove 212 extending from the first end surface 211 in an extending direction (Z), and communicating with the receiving space 24. The second seat portion 22 has a side surface 221 proximate to the passage 23, and a second end surface 222 connected to and transverse to the side surface 221. Specifically, in this embodiment, the second end surface 222 is parallel to the first end surface 211, and the side surface 221 is perpendicular to the first and second end surfaces 211, 222.

Referring to FIGS. 4 to 7, the clamping unit 3 includes a positioning member 31 and a resilient member 32. The positioning member 31 is connected to the first seat portion 21, and has an upper press section 311, a head section 312 connected to an end of the upper press section 311, a connecting section 313 connected to an opposite end of the upper press section 311, a tail section 314 connected to the connecting section 313, and a first contact 315. The upper press section 311, the head section 312, the connecting section 313 and the tail section 314 are disposed in the receiving space 24. The first contact 315 is bent outwardly from the connecting section 313 and extends outwardly of the second end surface 222 of the second seat portion 22 of the insulating base seat 2.

Figure 6:
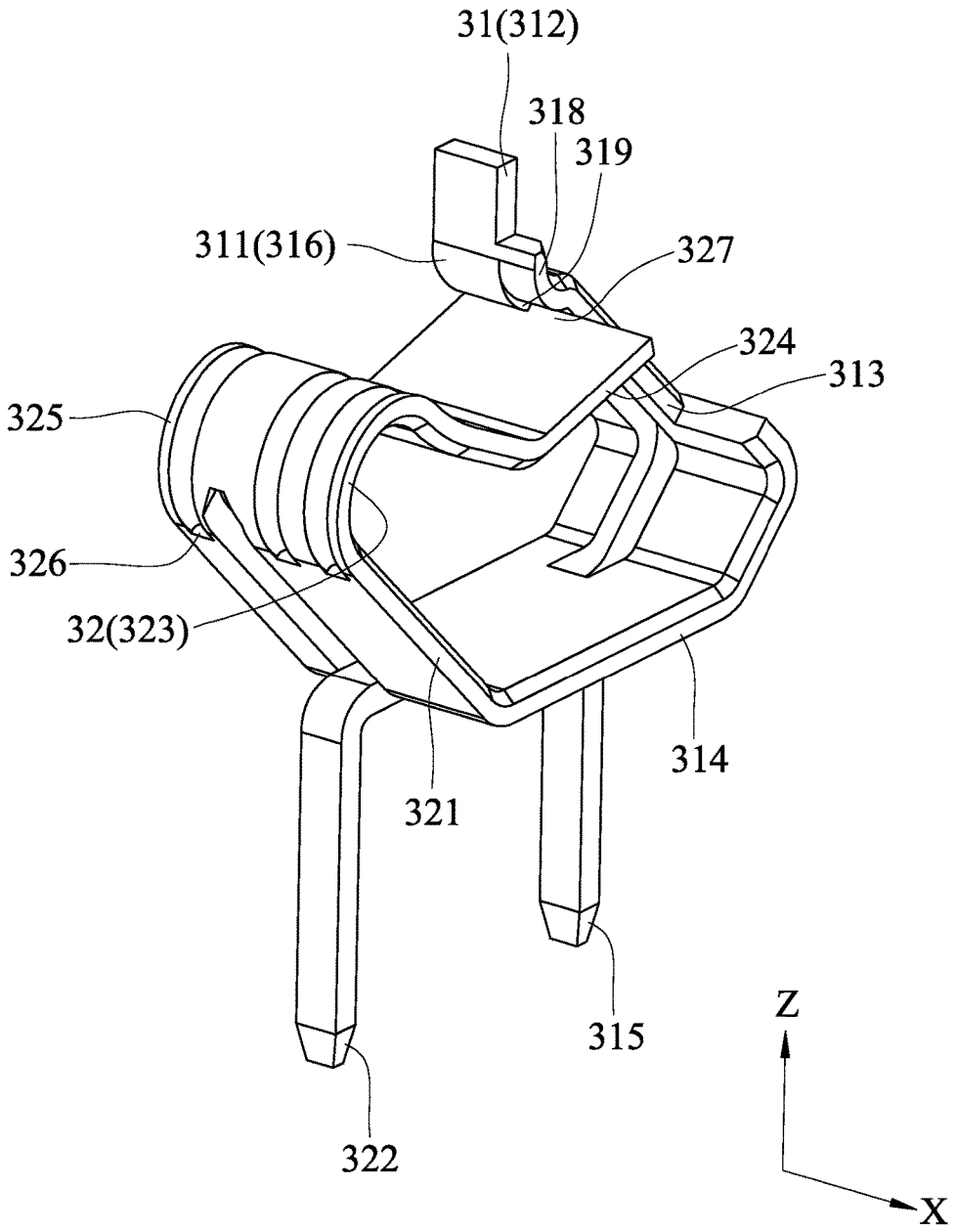
FIG. 6 is another perspective view of the clamping unit.

Referring to FIGS. 6 and 8, the upper press section 311 has a convex surface 316 connected to the head section 312 and adapted to facilitate insertion of the wire 6 into the receiving space 24, and a plane surface 317 interconnecting the convex surface 316 and the connecting section 313 of the positioning member 31. The convex surface 316 cooperates with the plane surface 317 to define an angle structure adapted to abut the wire 6 to prevent withdrawal of the wire 6 after the wire 6 is inserted into the receiving space 24.

Referring to FIGS. 4 to 6, the resilient member 32 has a base portion 321, a second contact 322, a bent portion 323, and a resilient arm portion 324. The base portion 321 is disposed in the receiving space 24 and proximate to the second seat portion 22 of the insulating base seat 2 and the tail section 314 of the positioning member 31. Specifically, the tail section 314 interconnects the connecting section 313 of the positioning member 31 and the base portion 321 of the resilient member 32. The second contact 322 is bent outwardly from the base portion 321 and extends outwardly of the second end surface 222 of the second seat portion 22 of the insulating base seat 2.

Figure 7:
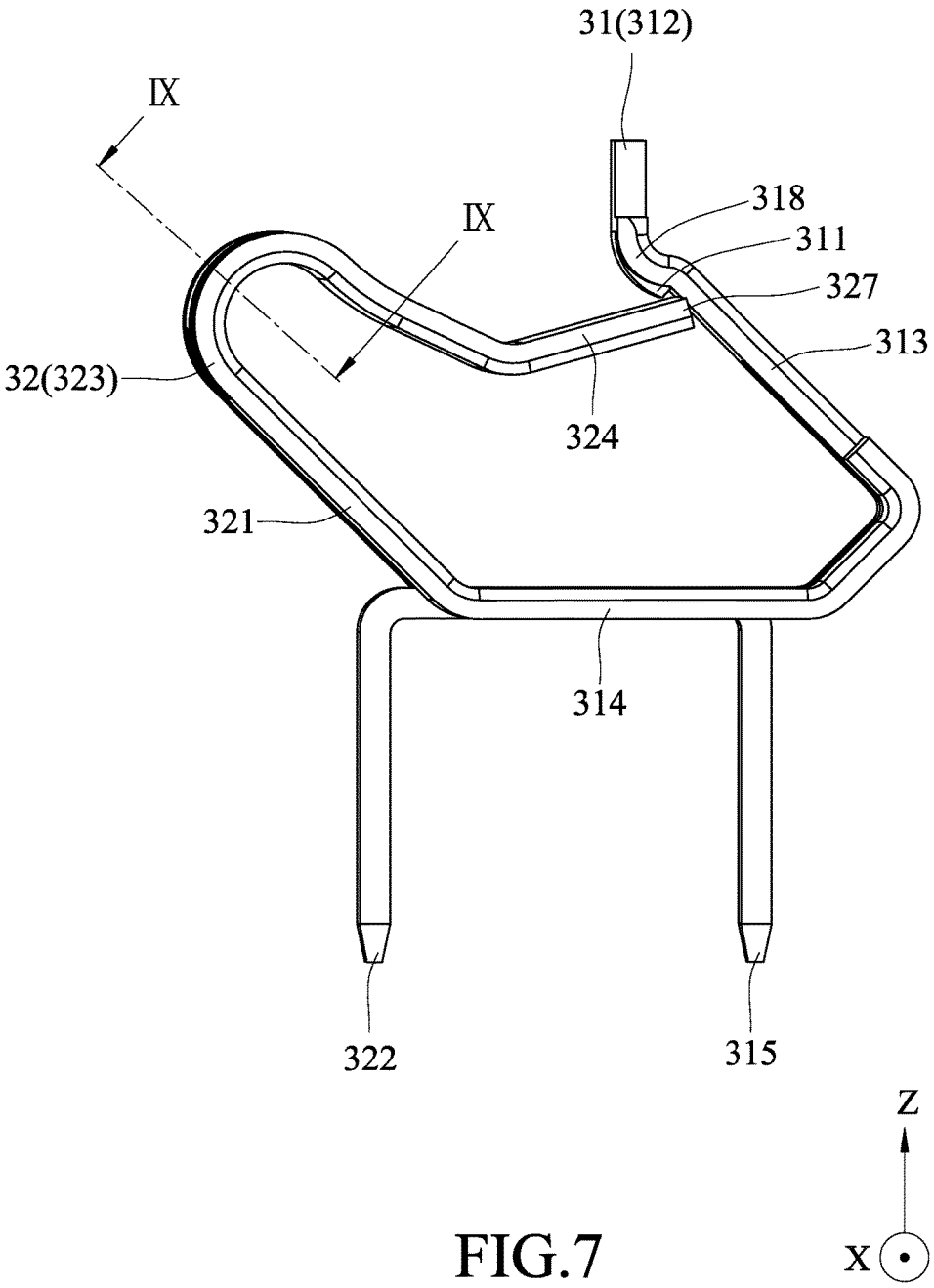
FIG. 7 is a side view of the clamping unit.
Figure 9:
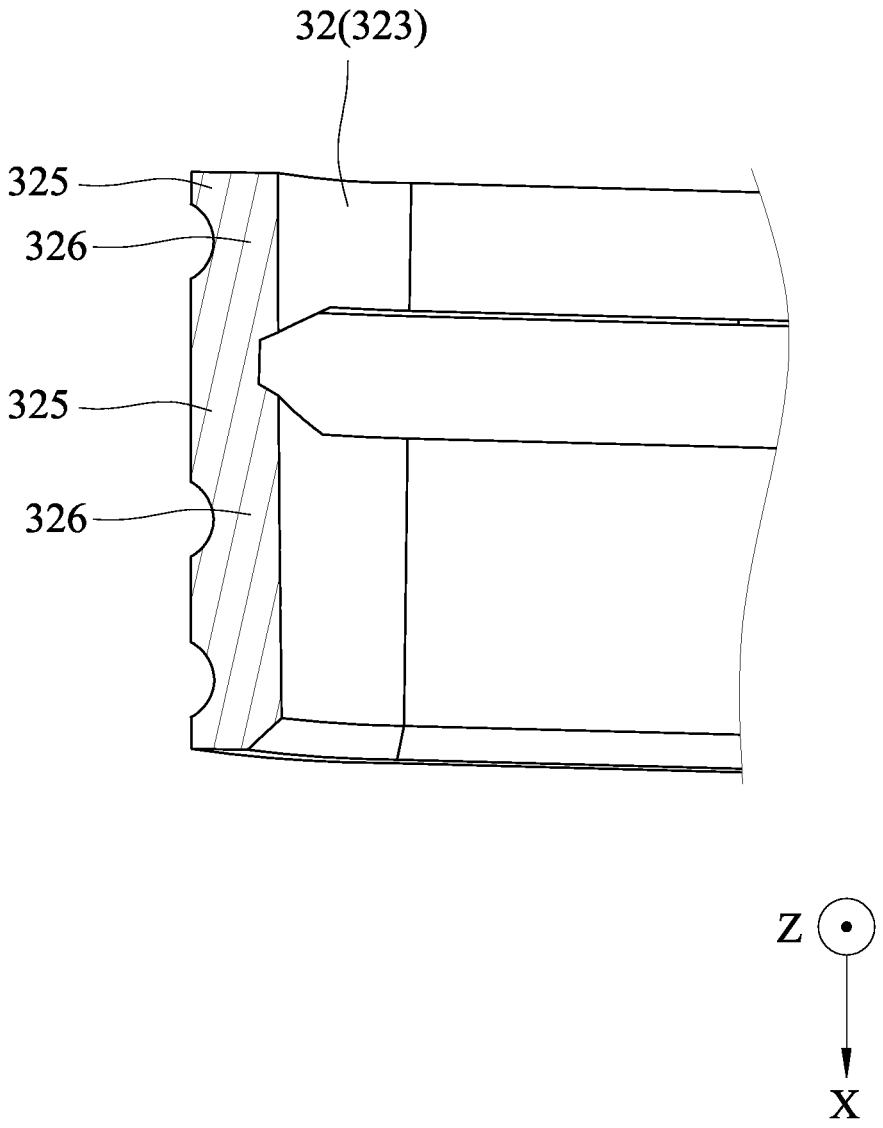
FIG. 9 is a fragmentary sectional view taken along line IX-IX in FIG. 7.

Referring to FIGS. 6, 7 and 9, the bent portion 323 is connected between the base portion 321 and the arm portion 324. The bent portion 323 has a plurality of ridge sections 325 and a plurality of trough sections 326 alternately arranged in an arranging direction (X) that is perpendicular to the extending direction (Z). Each of the trough sections 326 has a density higher than that of each of the ridge sections 325. In this embodiment, each of the trough sections 326 is formed by a stamping process. The abovementioned difference in density is a result of the stamping process, and improves the resilience of the arm portion 324. The arm portion 324 has a lower press section 327 distal from the base portion 321 and extends toward the positioning member 31.

In this embodiment, the positioning member 31 and the resilient member 32 are molded as one piece and are configured to be an electrically conductive terminal. It should be noted that the terminal is made of metal, but may be made of other electrically conductive materials in other embodiments. The positioning portion 31 further has a neck section 318 connected to the upper press section 311, the head section 312 and the connecting section 313. The neck section 318 and the upper press section 311 are arranged in the arranging direction (X), and cooperatively form a stepped structure 319 that is manufactured by stamping.

Figure 11:
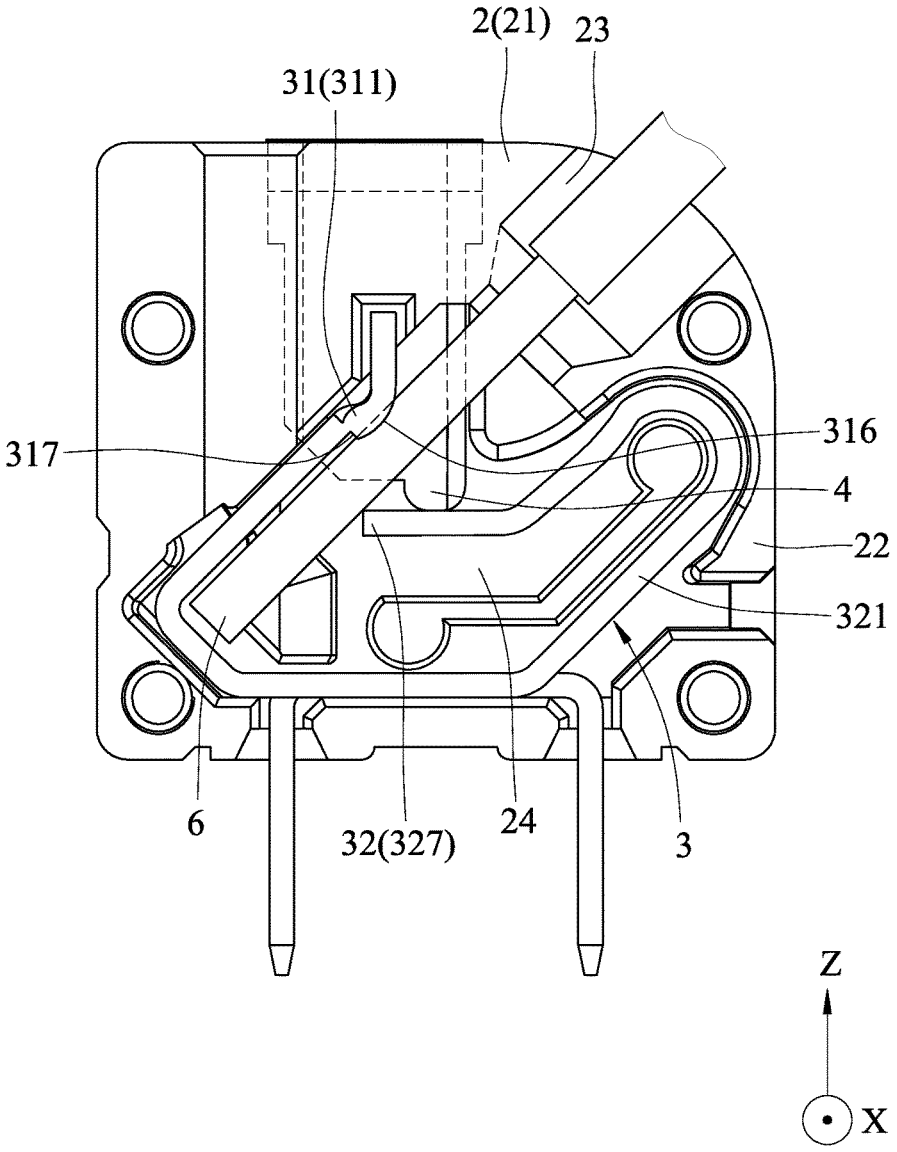
FIG. 11 is a side view illustrating the first embodiment with the wire being inserted thereinto and clamped between upper and lower press sections of the clamping unit.

Referring to FIGS. 4, 10 and 11, the releasing member 4 is movably disposed in the rail groove 212 of the first seat portion 21.

During use, when the wire 6 is inserted into the receiving space 24 through the passage 23 of the insulating base seat 2, the upper press section 311 of the positioning member 31 and the lower press section 327 of the resilient member 32 cooperatively and resiliently clamp the end segment of the wire 6 therebetween.

Figure 12:
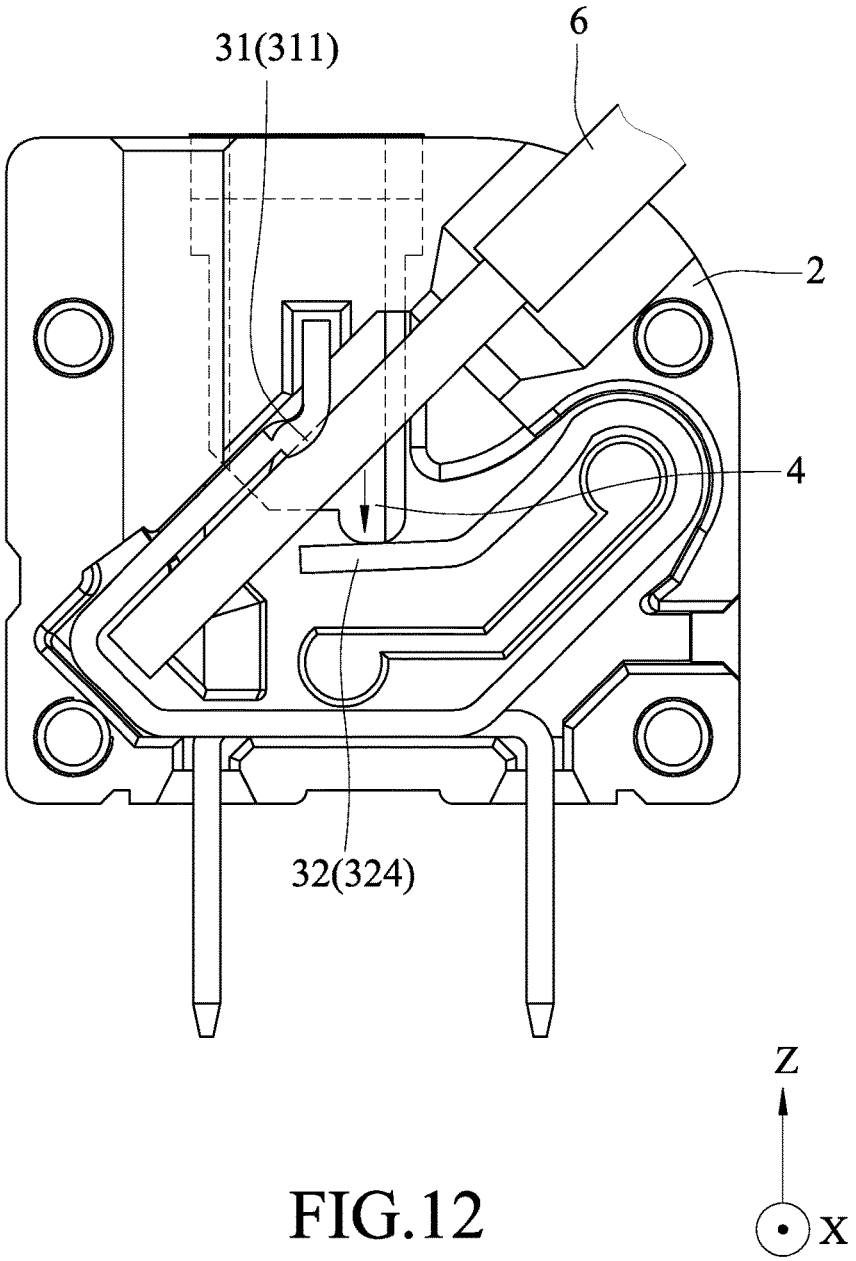
FIG. 12 is a view similar to FIG. 11, but illustrating a releasing member of the terminal block being moved to release the wire.

Referring to FIG. 12, when intending to remove the wire 6 from the terminal block of the present disclosure, the releasing member 4 is pressed to move in the extending direction (Z) to bias resiliently the arm portion 324 of the resilient member 32 away from the positioning member 31, thus the wire 6 can be pulled out of the insulating base seat 2.

Figure 13:
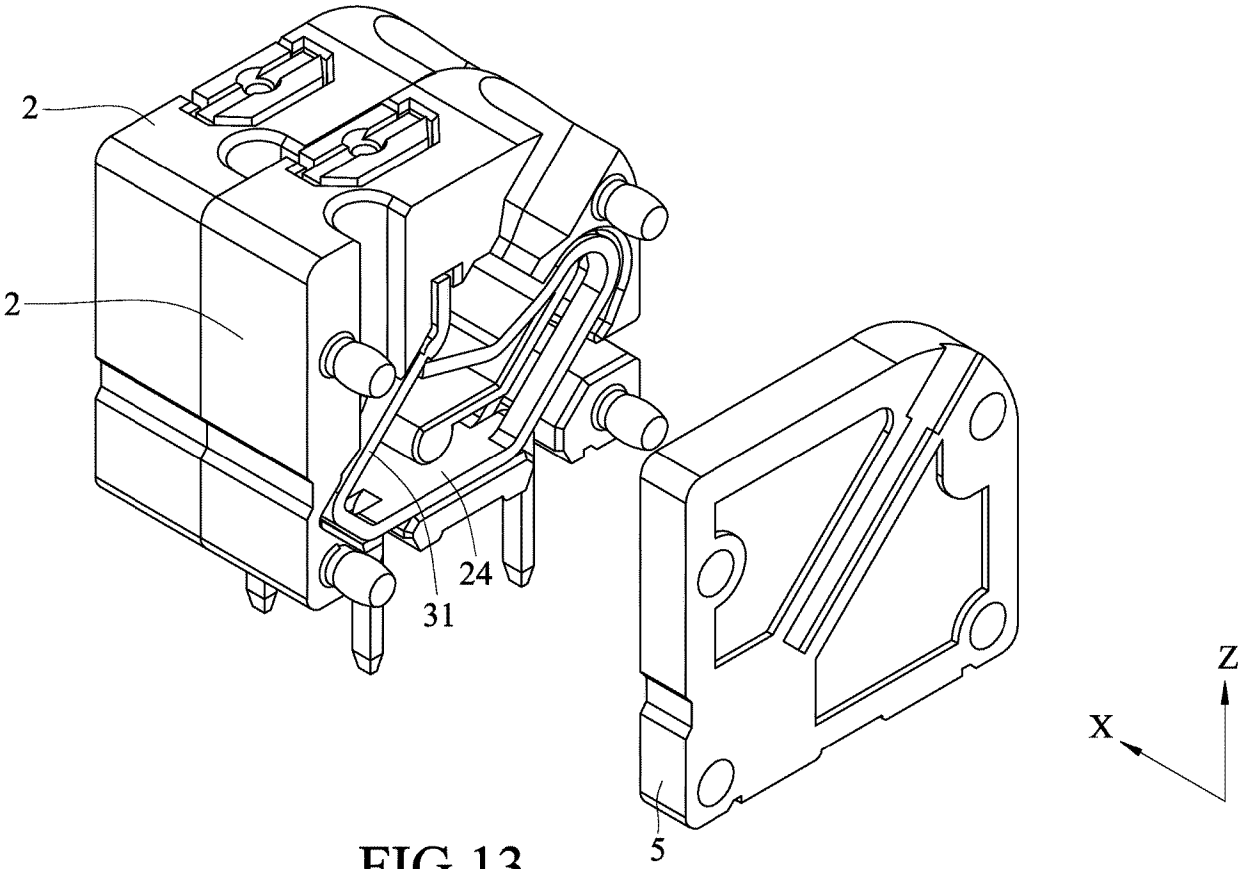
FIG. 13 is a perspective view of a second embodiment of the terminal block according to the present disclosure.

Referring to FIG. 13, a second embodiment of the terminal block according to the disclosure has a structure similar to the first embodiment. The main difference between this embodiment and the previous embodiment resides in that the terminal block includes two of the insulating base seats 2 connected to each other, and a cover member 5 disposed on one of the insulating base seats 2 and covering the receiving spaces 24 of the one of the insulating base seats 2.

With the above description, the advantage of the terminal block according to the present disclosure can be summarized in the following:

1. Unlike the wire 9 of the aforesaid conventional terminal block, the wire 6 can be more securely positioned by being clamped between the upper and lower press sections 311, 327.

2. By virtue of the convex surface 316 of the upper press section 311, the wire 6 can be smoothly inserted into the receiving space 24, thereby facilitating insertion of the wire 6.

3. Due to a structural design of the convex and plane surfaces 316, 317, the abutment of the angle structure against the wire 6 prevents withdrawal of the wire 6 when the terminal block is in use.

4. By virtue of integrated configuration of the positioning member 31 and the resilient member 32, the assembly time and the cost of the terminal block according to the present disclosure can be reduced.

In the description above, for the purposes of explanation, numerous specific details have been set forth in order to provide a thorough understanding of the embodiment. It will be apparent, however, t one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that his disclosure is not limited to the disclosed embodiment but is intended to cover various arrangements included within the spirit and scope of the broadest interpretation so as to encompass all such modifications and equivalent arrangements.

What is claimed is:

1. A terminal block adapted to be connected to a wire, said terminal block comprising:

an insulating base seat including a first seat portion, and a second seat portion that is connected to said first seat portion, and that cooperates with said first seat portion to define a passage adapted for insertion of the wire therethrough, and a receiving space communicating with said passage and adapted for receiving an end segment of the wire; and a clamping unit including a positioning member that is connected to said first seat portion, and that has an upper press section, and a resilient member that has a base portion proximate to said second seat portion, and a resilient arm portion connected to said base portion, and having a lower press section that is distal from said base portion and that extends toward said positioning member, said upper press section of said positioning member and said lower press section of said arm portion of said resilient member being adapted for cooperatively and resiliently clamping the end segment of the wire therebetween;

wherein said positioning member and said resilient member are molded as one piece and are configured to be an electrically conductive terminal.

2. The terminal block as claimed in claim 1, wherein said positioning member of said clamping unit further has a head section connected to an end of said upper press section, a connecting section connected to an opposite end of said upper press section, and a tail section interconnecting said connecting section and said base portion of said resilient member.

3. The terminal block as claimed in claim 2, wherein:

said upper press section has a convex surface connected to said head section and adapted to facilitate insertion of the wire into said receiving space, and a plane surface interconnecting said convex surface and said connecting section of said positioning member; and said convex surface cooperates with said plane surface to define an angle structure adapted to abut the wire to prevent withdrawal of the wire when the wire is inserted into the receiving space.

4. The terminal block as claimed in claim 3, wherein:

said positioning member further has a neck section connected to said upper press section, said head section, and said connecting section; and said neck section and said upper press section are arranged in an arranging direction, and cooperatively form a stepped structure.

5. The terminal block as claimed in claim 2, wherein said resilient member further has a bent portion connected between said arm portion and said base portion, and having a plurality of ridge sections and a plurality of trough sections that are alternately arranged in an arranging direction.

6. The terminal block as claimed in claim 5, wherein each of said trough sections of said bent portion of said resilient member has a density higher than that of each of said ridge sections.

7. The terminal block as claimed in claim 2, wherein:

said first seat portion of said insulating base seat has an end surface proximate to said passage, and a rail groove extending from said end surface in an extending direction, and communicating with said receiving space; and said terminal block further comprises a releasing member disposed in said rail groove, and is movable in the extending direction to bias resiliently said arm portion of said resilient member away from said positioning member.

8. The terminal block as claimed in claim 2, wherein:

said second seat portion of said insulating base seat has a side surface proximate to said passage, and an end surface connected to and transverse to said side surface; and said positioning member further has a first contact bent outwardly from said connecting section and extending outwardly of said end surface.

9. The terminal block as claimed in claim 8, wherein said resilient member further has a second contact bent outwardly from said base portion and extending outwardly of said end surface of said second seat portion of said insulating base seat.

10. The terminal block as claimed in claim 9, further comprising a cover member disposed on said insulating base seat and covering said receiving space.

* * * * *